US010327568B2

(12) United States Patent
Resch

(10) Patent No.: US 10,327,568 B2
(45) Date of Patent: Jun. 25, 2019

(54) FREEZER CABINET

(71) Applicant: AHT Cooling Systems GmbH, Rottenmann (AT)

(72) Inventor: Reinhold Resch, St. Peter (AT)

(73) Assignee: AHT Cooling Systems GmbH, Rottenmann (AT)

( * ) Notice: Subject to any disclaimer, the term of this patent is extended or adjusted under 35 U.S.C. 154(b) by 297 days.

(21) Appl. No.: 15/302,306

(22) PCT Filed: Mar. 20, 2015

(86) PCT No.: PCT/EP2015/055954

§ 371 (c)(1),
(2) Date: Oct. 6, 2016

(87) PCT Pub. No.: WO2015/154970

PCT Pub. Date: Oct. 15, 2015

(65) Prior Publication Data

US 2017/0027338 A1 Feb. 2, 2017

(30) Foreign Application Priority Data

Apr. 8, 2014 (DE) ..... 20 2014 101 651 U

(51) Int. Cl.
*A47F 3/04* (2006.01)
*F25D 23/02* (2006.01)

(52) U.S. Cl.
CPC ..... *A47F 3/043* (2013.01); *A47F 3/0434* (2013.01); *F25D 23/026* (2013.01)

(58) Field of Classification Search
CPC ..... A47F 3/043; A47F 3/0434; F25D 23/026; F25D 23/021
See application file for complete search history.

(56) References Cited

U.S. PATENT DOCUMENTS 2,694,613 A 11/1954 Williams
4,949,554 A * 8/1990 Branz ..... A47F 3/0404 62/248
7,066,436 B2 * 6/2006 Honda ..... B60N 3/101 220/254.9

FOREIGN PATENT DOCUMENTS

JP S49 9602 U 1/1974
JP S54 23249 A 2/1979
WO 2012/066429 A1 5/2012

* cited by examiner

*Primary Examiner* — Andrew T Kirsch
(74) *Attorney, Agent, or Firm* — Jansson Munger McKinley & Kirby Ltd.

(57) ABSTRACT

A freezer cabinet in which foods are stored frozen for sale in a shop. The freezer cabinet includes a freezer space surrounded by solid walls at the front, the rear, the sides and at the bottom. The freezer space, at its upper end, is accessible via a housing opening from a user-side front edge, such opening, in the closed state, is covered by a cover unit with a cover part, adjoining the use-side edge and movable in a forwards/backwards direction, and a stationary rear cover part is located away from the user-side edge. In order to open the freezer cabinet, the front cover part is arranged in front of the rear cover part in the closed state or the central cover part can be pushed at least partially over the rear cover part.

8 Claims, 1 Drawing Sheet

Detail A
Detail B
Detail C
A
B
C

FREEZER CABINET

CROSS-REFERENCE TO RELATED APPLICATION

The present application is a U.S. national phase entry of pending International Patent Application No. PCT/EP2015/055954, international filing date Mar. 20, 2015, which claims priority to German Patent Application No. DE 20 2014 101 651.1, filed Apr. 8, 2014, the contents of which are incorporated by reference in their entireties.

FIELD OF THE INVENTION

The device relates to a freezer cabinet for cold storage and showcasing of food in a sales room, with a cooling chamber that is surrounded by stationary housing walls at the front, rear, sides, and bottom and is accessible from a front edge oriented toward the user via a housing opening at the top, which in the closed state, is covered by a cover unit with a lid part, which adjoins the user-side edge and can be moved in a forward/backward direction, and a stationary rear lid part positioned away from the user-side edge.

BACKGROUND OF THE INVENTION

Freezer cabinets are well known in the art. An example of a freezer cabinet of the prior art is disclosed in EP 1 332 698 B3. Another freezer cabinet is disclosed in DE 10 2009 031 278 A1. The freezer in this patent includes a chest opening with two access sides opposite from each other and a cover with sliding lids that can be moved in the transverse direction, and a middle lid that can be moved in the transverse direction, wherein the sliding lids at the sides each have a catch that automatically moves the middle lid along with them as they are opened.

EP 2 347 680 A1 discloses another freezer cabinet with a cover and a plurality of lids that can be slid over one another in the transverse direction. They are likewise coupled to each other through a catch system. All of the disclosed prior art patents have specific disadvantages to which the present device improves upon.

One object of the present invention is to distinguish over the shortcomings seen in the prior art by providing a freezer cabinet which has a user-friendly cover. The freezer of the present invention includes a cooling chamber accessible from two long sides and covered at the top by a cover that has lids that can be slid along the two long sides perpendicular to the long sides and in the middle region between the long sides, and having a stationary cover plate. The cover can be convexly curved. Guide rails at the sides have three tracks and the stationary cover plate is positioned in a separate track that is preferably the uppermost of the three tracks.

SUMMARY OF THE INVENTION

In accordance with the present device, a freezer cabinet for cold storage and showcasing of foods in a sales room comprising a cooling chamber surrounded by stationary housing walls including a front wall, a rear wall, sidewalls, and a bottom wall, the chamber being accessible from a front edge oriented toward the user via a housing opening at a top, which in the closed state, the top is covered by a cover unit with a lid part, the lid part adjoins a user-side edge and can be moved in a forward/backward direction, the chamber also including a front lid part, middle lid part and stationary rear lid part positioned away from the user-side edge, to open the chamber the front and middle lid parts are arranged in front of the rear lid part in the closed state and can be pushed at least partially over the rear lid part.

It is preferred that the rear lid part that adjoins the rear edge of the housing opening is inserted in a non-sliding fashion into a rear frame section and two side frame sections in a way that allows it to be removed toward the top. The front lid part is curved so that in the cross-section extending from front to back, it is convex toward the top. Preferably, the front lid part includes front and rear regions and has corresponding front and rear guide pins that protrude laterally beyond edges on both sides of the chamber and engage in upper guide rails that are provided on both sides.

It is also preferred that the upper guide rails have an upper retaining bar that has at least one respective gap that the guide pins and can be inserted into and guided out of a corresponding sliding position of the front lid part.

It is highly preferred that only the front lid part is curved so that the front lid part is convex toward the top whereas the middle and rear lid parts are flat. Preferably, the front lid part includes an upward protruding handle at its front edge and the front and middle lid parts are supported in sliding fashion in the lateral guide rails in the lateral frame sections so that during the opening motion, the middle lid part slides over the rear lid part and the front lid part slides over the middle lid part.

In preferred embodiments, the front and middle lid parts are coupled to each other by a catch device, the catch device being configured so that when the front lid part is slid, the middle lid part is also slid forward or back in the same, corresponding direction. The catch device is configured so that during the opening motion, the front lid part is first slid over the middle lid part and as the opening motion continues, the front lid part is then slid together with middle lid part over the rear lid part.

It is preferred that the catch device is configured so that when closing from the fully-open state, the front lid part is first slid forward out of the area above the middle lid part and then the middle lid part is next slid together with the front lid part into the closed position.

Preferably, the catch device has a front catch element protruding downward in the front region of the front lid part and a rear catch element protruding downward in the rear region of the front lid part; in a complete opening motion, the front catch element comes into abutting contact with a stop in the front edge region of the middle lid part in order to slide the middle lid part toward the rear; and when closing the front lid part from the fully open state, the front lid part is slid forward by itself at first and then with its rear catch element the front lid part comes into abutting contact with a second stop in the front edge region of the middle lid part in order to drive the latter toward the front into the closed position.

In the present device, in order to open the front lid part and/or middle lid part arranged in front of the rear lid part in the closed state, it/they can be slid at least partway over the rear lid part. These measures provide for a reliable function with good operating properties in a preferred design. An embodiment that is advantageous for the design and operation is comprised in that the rear lid part that adjoins the rear edge of the housing opening is inserted in a non-sliding fashion into a rear frame section and two side frame sections in a way that allows it to be removed toward the top.

With a relatively large cooling chamber or storage chamber, the accessibility is improved in that at least the front lid part is curved so that in the cross-section extending from front to back, it is convex toward the top. This embodiment achieves significant functional advantages in combination with the features of the preceding claims, where the low front edge of the housing opening also offers a good view of the products laid out in the cooling chamber through the transparent cover unit.

If the front lid part, in its front and rear regions, is provided with front and rear guide pins that protrude laterally beyond the edges on both sides and that engage in upper guide rails that are provided for them on both sides, then this allows a particularly simple sliding motion, allowing a wide latitude in the selection of the curvature of the front lid part and permitting it to be adapted to different functional and/or operational requirements. The guide tracks in the guide rails in this case do not have to be adapted to the curvature of the front lid part and the curved lid part does not, for example, have to be made of a flexible material, thus offering improved design possibilities. In the closed state, the convex curvature of the front lid part essentially corresponds to the curvature of the front region of the lateral guide rails in order to also achieve a reliable seal by the cover unit at the sides of the cooling chamber.

Other usage advantages are achieved by the fact that the upper guide rails have an upper retaining bar that has at least one respective gap that the guide pins can be inserted into and guided out of in a corresponding sliding position of the front lid part.

An embodiment that is functionally and operationally advantageous is comprised in that a front, middle, and rear lid part are provided and only the front lid part is curved so that it is convex toward the top whereas the middle and rear lid parts are embodied as flat. This contributes to a good sliding ability, particularly also of the front lid part since it lies with its rear region over the flat middle lid part already at the beginning of the sliding motion and only slight sliding forces are required.

For the function and operation, an advantageous contribution is also made by the fact that the front lid part is provided with an upward protruding handle at its front edge and the front and middle lid parts are supported in sliding fashion in the lateral guide rails in the lateral frame sections so that during the opening motion, the middle lid part is slid over the rear lid part and the front lid part is slid over the middle lid part.

Another user-friendly embodiment is comprised in that the front and middle lid parts are coupled to each other by a catch device, which is embodied so that when the front lid part is slid, the middle lid part is also slid forward or back in the corresponding direction. This achieves an advantageous function in that the catch device is embodied so that during the opening motion, first the front lid part is slid over the middle lid part and as the opening motion continues, the front lid part is slid together with middle lid part over the rear lid part.

It is also advantageous for the operation that the catch device is embodied so that when closing from the fully open state, first the front lid part is slid forward out of the region above the middle lid part and then the middle lid part is slid together with the front lid part into the closed position. Other advantages for the design and function lie in the fact that the catch device has a front catch element protruding downward in the front region of the front lid part and a rear catch element protruding downward in the rear region of the front lid; in a complete opening motion, the front catch element comes into abutting contact with a stop in the front edge region of the middle lid part in order to slide the middle lid part toward the rear; and when closing the front lid part from the fully open state, it is slid forward by itself at first and then with its rear catch element, comes into abutting contact with another stop in the front edge region of the middle lid part in order to drive the latter toward the front into the closed position.

BRIEF DESCRIPTION OF THE DRAWINGS

The drawings illustrate a preferred embodiment including the above-noted characteristics and features of the device. The device will be readily understood from the descriptions and drawings. In the drawings.

DETAILED DESCRIPTION OF PREFERRED EMBODIMENTS

Figures 1A, 1B, 1C, 1D:
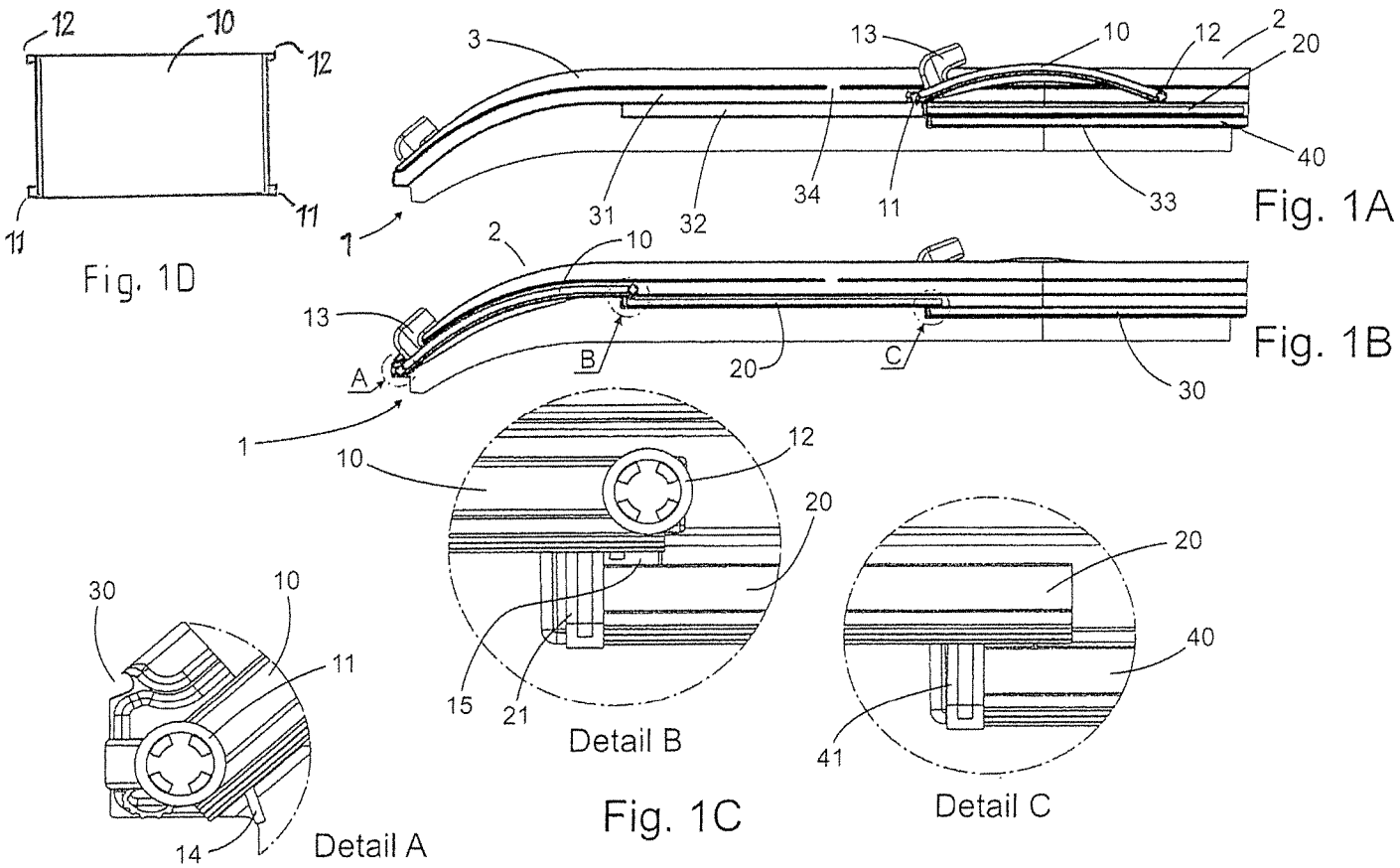
FIG. 1A is a side view of the upper region of a freezer cabinet with a cover unit and a guide unit in the closed position.
FIG. 1B shows the cover unit according to FIG. 1A in the open position.
FIG. 1C shows three details A, B, and C indicated in FIG. 1A.
FIG. 1D is a schematic top view of a front lid part of the cover unit.

Referring to FIGS. 1A-1C, a freezer cabinet 1 in accordance with the present invention is generally designated by the reference numeral 1. FIG. 1A shows the upper region of a freezer cabinet 1 (otherwise not shown in detail) with a cover unit 2. Freezer cabinets 1 of this kind are particularly used for the refrigerated storage and sale of foods in sales rooms. The freezer cabinet which as a rule is essentially block-shaped, has housing walls at the front, rear, sides, and bottom that form a housing body and enclose a cooling chamber with a housing opening at the top, which is covered by a cover unit 2 and can be opened in order to fill the cooling chamber with food and make it possible for a customer to take food out. The cover unit 2 is embodied so that it is entirely or largely transparent in order to present the products or foods and has a plurality of rear lid parts that can be slid in a guide unit 30 and that can be moved at least partway into an open position and from there, back into the closed position.

In the exemplary embodiment shown in FIGS. 1A and 1B, cover unit 2 has three lid parts, namely a front lid part 10, which in the closed state, is situated in the front region of the housing opening oriented toward a user, a middle lid part 20 adjoining the latter toward the rear, and a rear lid part 40 situated in the rear region of the housing opening. At least the front and middle lid parts 10, 20 are inserted into a lid guide 3, which is provided at the lateral edges of the housing opening. In the illustration of cover unit 2 shown, the rear lid part 40 is inserted in a non-sliding fashion into a rear frame section and two side frame sections in a way that allows it to be removed toward the top, making it possible if need be to enable free access to the rear region of the cooling chamber as well, e.g. for stocking or cleaning purposes.

To open the unit, front lid part 10 can be slid over middle lid part 20 and, if further opening is desired, can be slid together with middle lid part 20 over rear lid part 40. To this end, the lid guide 3 has a guide unit 30 with upper guide rails 31 and middle guide rails 32 on both sides of the housing opening, with front lid part 10 supported in sliding fashion in upper guide rails 31 and middle lid part 20 supported in sliding fashion in middle guide rails 32. The side, rear frame sections in which the rear lid part 40 is accommodated can be embodied as lower guide rails 33 of the guide unit 30.

Advantageously, as shown in FIG. 1D, front lid part 10 is provided with laterally protruding front guide pins 11 in its two front side regions and with laterally protruding rear guide pins 12 in its two rear side regions, which pins are formed, for example, onto the side, front, or rear frame-like enclosures of front lid part 10 or can be mounted to them separately. Enlarged depictions of front and rear guide pins 11, 12 are shown in details A and B of FIG. 1C. They can be provided with roller-like elements to facilitate movement of front lid part 10.

As is clear from FIG. 1B, this design of front lid part 10 with front and rear side guide pins 11, 12 allows front lid part 10 to be embodied with any curvature that is convex toward the top since it protrudes above middle lid part 20 when slid over it. It is also not necessary for front lid part 10 to be embodied of an elastic or flexible material, thus enabling a wide variety of design variants in terms of material selection and shape. For example, front lid part 10 can have a relatively tight curvature radius so that on the one hand, a front upper edge can be lower with a relatively high rear edge and side edges and as a result, the products laid out in the cooling chamber are easily visible and accessible from the front, through the transparent front lid part 10. In this case, the convex curvature toward the top places practically no restriction on the size of the cooling chamber due to the low front edge of the housing opening.

In the exemplary embodiment shown, while front lid part 10 is curved so that in the cross-section extending from front to back, it is convex toward the top, middle lid part 20 and rear lid part 40 are embodied as flat and preferably lie horizontally (relative to the force of gravity), benefitting the design and functionality of the freezer cabinet. In the closed position, the upwardly convex curvature of front lid part 10 and the curvature of the side guide rails coincide so that cover unit 30 also rests in a sealed fashion at the side against the edge of the housing opening. In addition, the curvature of the guide rails and the convex curvature are matched to each other so that viewed from the side, front lid part 10 does not lie below the curvature path of the guide rails over the entire sliding path, thus always assuring an unhindered sliding action.

Front lid part 10 is provided in its front region (preferably in the front fourth) with a handle 13 on its top side, which enables a simple operation when sliding back into the open position and sliding forward into the closed position. So that middle lid part 20 does not have to be separately grasped by the user during the opening and closing, but instead can be driven by front lid part 10 to move along with it, a catch device is provided. This catch device is preferably embodied so that during the opening motion, first front lid part 10 is slid over middle lid part 20 and then, as the opening motion continues, front lid part 10 drives middle lid part 20 to move along with it, causing middle lid part 20 to be slid together with front lid part 10 over rear lid part 40.

During the closing motion, first front lid part 10 is moved forward out of the region of middle lid part 20 and then, as front lid part 10 is slid further forward, middle lid part 20 is slid out from the region of rear lid part 10 until the closed position is reached.

For example, the catch device has a front catch element 14 that protrudes downward from the underside of the front region of front lid part 10 and a rear catch element 15 that protrudes downward from the underside of the rear region of front lid part 10, while at its front edge, middle lid part 20 has a protrusion, e.g., a raised front frame section 21, protruding up beyond its surface, whose rear side is engaged from behind by rear catch element 15 of front lid part 10. If front lid part 10 is slid backward for the opening action, it is first moved alone over middle lid part 20 until its front catch element 14 comes into abutting contact with the front edge, for example the front frame section 21, of middle lid part 20 and then as it is slid further back, middle lid part 20 is slid along with it until the rear end position is reached, in which middle lid part 20 and front lid part 10 are positioned at least largely over rear lid part 40. During the closing motion, first front lid part 10 is slid toward the front until its rear catch element 15 comes into abutting contact with the protrusion or upward-protruding front frame section 21 of middle lid part 20 and then, as it is slid further forward, drives middle rear lid part 20 to move along with it until the closed position is reached. In the closed position, the rear region of front lid part 10 overlaps the front region of middle lid part 20 slightly and correspondingly, the rear region of middle lid part 20 overlaps the front region of rear lid part 40 so that the housing opening is securely closed. A front frame section 21 of rear lid part 40 can be mounted at the front edge of rear lid part 40, for example, for sealing purposes.

As also shown in FIGS. 1A and 1B, in the region of two upper guide rails 31, an upper, lateral, inward-oriented retaining bar of guide unit 30, which serves to secure front lid part 10 in the region of guide pins 11, 12, is provided with a gap 34 so that in a corresponding sliding position for removal toward the top, guide pins 11, 12 can be guided up out of upper guide rail 31 or inserted down into it, allowing front lid part 10 to be removed from or inserted into guide unit 10 via gap 34.

The freezer cabinet can be divided into a plurality of compartments or cooling chambers by partition walls inserted from front to back (in the transverse direction), it being possible for each compartment to be covered by a cover unit 2 according to the above-described design. In this case, relevant guide units 30 advantageously have guide tracks provided at the upper edge of the partition walls, with an upper, middle, and lower guide rail 31, 32, 33, as described above.

A wide variety of materials are available for the various parts discussed and illustrated herein. While the principles of this invention have been described in connection with specific embodiments, it should be understood clearly that these descriptions are made only by way of example and are not intended to limit the scope of the invention.

The invention claimed is:

1. A freezer cabinet for cold storage and showcasing of foods in a sales room, comprising a cooling chamber surrounded by stationary housing walls including a front wall, a rear wall, sidewalls, and a bottom wall, the chamber being accessible from a user-side front edge via a housing opening at a top side thereof, which, in the closed state, is covered by a cover unit having a lid part that adjoins the user-side edge and can be moved in a forward/backward direction and a stationary rear lid part that is positioned away from the user-side edge, wherein, to open up, the front lid part, arranged in front of the rear lid part in the closed state, and/or a middle lid part can be pushed at least partially over the rear lid part, characterized in that the front lid part is provided, in the front and rear regions thereof, laterally on both sides, with front and rear guide pins that protrude laterally over the edges, which guide pins engage with upper guide rails provided on both sides, and the upper guide rails are curved and have an upper retaining bar that has at least one respective gap through which the guide pins can be inserted and guided out when the front lid part is in a corresponding sliding position, wherein at least the front lid part is curved so as to be upwardly convex in cross-section extending from front to back so that the front lid part protrudes above the middle lid part when the front lid part is slid over the middle lid part and wherein in the closed state the upwardly convex curvature of the front lid part and the curvature of side guide rails contact each other so that the cover unit rests in a sealed position on a side which is against an edge of the housing opening.

2. The freezer cabinet of claim 1 wherein the rear lid part that adjoins the rear edge of the housing opening is inserted in a non-sliding fashion into a rear frame section and two side frame sections in such a manner as to allow upward removal.

3. The freezer cabinet of claim 2 wherein that a front, middle, and rear lid part are present, and only the front lid part is curved so as to be upwardly convex, whereas the middle and rear lid parts are flat.

4. The freezer cabinet of claim 3 wherein the front lid part is provided near the front edge thereof with an upwardly-protruding handle, and the front and middle lid parts are mounted in sliding fashion in the lateral guide rails configured in the lateral frame sections so that on opening, the middle lid part slides over the rear lid part and the front lid part slides over the middle lid part.

5. The freezer cabinet of claim 4 wherein the front and middle lid parts are coupled to each other by a catch device, the catch device being configured so that when the front lid part is slid, the middle lid part is also slid in the corresponding direction forward or back.

6. The freezer cabinet of claim 5 wherein the catch device is configured so that on opening, the front lid part is first slid over the middle lid part, and as the opening motion continues, the front lid part is then slid together with middle lid part over the rear lid part.

7. The freezer cabinet of claim 6 wherein the catch device is configured so that on closing from the fully-open state, the front lid part is first slid forward out of the area above the middle lid part, and then the middle lid part is next slid together with the front lid part into the closed position.

8. The freezer cabinet of claim 7 wherein the catch device has a front catch element protruding downward in the front region of the front lid part and a rear catch element protruding downward in the rear region of the front lid part; on complete opening, the front catch element comes into abutting contact with a stop in the front edge region of the middle lid part in order to slide the middle lid part toward the rear; and on closing the front lid part is slid forward from the fully open state, by itself at first, and then with the rear catch element thereof, the front lid part comes into abutting contact with a second stop in the front edge region of the middle lid part in order to drive the latter toward the front into the closed position.

* * * * *